US005730361A

United States Patent [19]

Thönnes

[11] Patent Number: 5,730,361

[45] Date of Patent: Mar. 24, 1998

[54] SHOWER HEAD WITH DECALCIFICATION BY DEFLECTING ELASTIC NOZZLES

[75] Inventor: Theo Thönnes, Darscheid, Germany

[73] Assignee: Ideal-Standard GmbH, Bonn, Germany

[21] Appl. No.: 433,355

[22] PCT Filed: Oct. 20, 1993

[86] PCT No.: PCT/EP93/02895

§ 371 Date: May 2, 1995

§ 102(e) Date: May 2, 1995

[87] PCT Pub. No.: WO94/09910

PCT Pub. Date: May 11, 1994

[30] Foreign Application Priority Data

Nov. 4, 1992 [AT] Austria ..... 2183/92

[51] Int. Cl.[6] ..... B05B 15/02

[52] U.S. Cl. ..... 239/106; 239/533.12; 239/602

[58] Field of Search ..... 239/548, 533.13, 239/552, 553, 553.3, 553.5, 556, 601, 602, 106, DIG. 12; 601/17, 136, 137, 138, 154, 155, 160, 169

[56] References Cited

U.S. PATENT DOCUMENTS

| | | | |
|---|---|---|---|
| 2,402,741 | 6/1946 | Draviner | 239/DIG. 12 |
| 5,172,862 | 12/1992 | Heimann et al. | 239/602 |

FOREIGN PATENT DOCUMENTS

| | | |
|---|---|---|
| 0435300 | 7/1991 | European Pat. Off. . |
| 0443538 | 9/1991 | European Pat. Off. . |
| 923349 | 7/1947 | France . |
| 3044310 | 6/1982 | Germany . |
| 4039337 | 7/1991 | Germany . |
| 3107808 | 9/1992 | Germany . |

*Primary Examiner*—Andres Kashnikow
*Assistant Examiner*—Steven J. Ganey
*Attorney, Agent, or Firm*—Herbert Dubno

[57] ABSTRACT

A shower head with a spray plate mounted on the housing has water passage openings and a further plate made of elastic material which has openings coaxial to the water passage openings. The further plate is fitted over the outside of the spray plate which presses against it. Nozzle projections with exit openings are formed coaxial with respect to the openings which have a smaller diameter than the water passage openings.

3 Claims, 2 Drawing Sheets

SHOWER HEAD WITH DECALCIFICATION BY DEFLECTING ELASTIC NOZZLES

CROSS REFERENCE TO RELATED APPLICATIONS

This application is a national phase of PCT/EP93/02895 filed 20 Oct. 1993 and based, in turn, on Austrian national application A2183/92 filed 4 Nov. 1992 under the International Convention.

FIELD OF THE INVENTION

My present invention relates to a shower head with a spray plate having perforations for the passage of water and mounted in a housing.

BACKGROUND OF THE INVENTION

In order to obtain a water jet which is pleasant to the skin with a shower head, the spray plate of the shower head can have many small water outlet openings. There is a problem with such shower heads because due to calcification or contamination the water passages can become narrowed or completely clogged, which results in uneven water jets and incorrect alignment of individual water jets.

Up to now this problem was solved mostly by chemical means, whereby either the shower head had to be kept for a long time in a decalcifying solution, or correspondingly more aggressive chemicals had to be used. These procedures are time consuming, are damaging especially to the plastic components of the shower head and are environmentally unsafe. Furthermore in cases of advanced calcification is not possible to remove the deposits completely. A mechanical approach is also known, wherein pins arranged on a plate are pressed from time to time through the openings in the spray plate, thereby clearing these openings. If the pin-bearing plate is made an integral part of the shower head, the volume and weight of the shower head are increased and the device for the introduction of the pins into the openings of the spray plate also becomes subject to contamination and calcification. Due to the hardness of the calcification and the fineness of the openings, high requirements have to be met by the material of the pins, which in spite of a very small diameter are not allowed to bend.

OBJECT OF THE INVENTION

It is the object of the present invention to provide a shower head with an improved way of freeing the outlet of contamination and calcium deposits in a simple, quick and environmentally friendly manner.

SUMMARY OF THE INVENTION

This object is attained by providing the spray plate with a further plate having nozzles coaxial to the water passage openings and made of an elastic material, whereby the nozzles have exit openings which are smaller than the water passage openings. The fineness of the jets is given by the size of the exit openings of the nozzles and the water passage openings in the spray plate can be selected so big that they are no longer clogged by contaminations or calcium deposits. In order to clean the nozzles made of an elastic material, they are bent back and forth several times, so that the hard deposits on the inner nozzle walls crack up and are rinsed out by the passing water jet. The back-and-forth bending of the nozzles can be done by hand or also by using the shower head with the projecting nozzles in the manner of a brush for body massages.

Advantageously in the shower head of the invention the further plate with the nozzles is made in one piece and of elastic material. It is simple to produce and avoids sealing problems.

Further each nozzle has an inner diameter which is bigger then the thickness of its walls, this way permitting an easy bending of the nozzle.

Furthermore according to a preferred embodiment the inner diameter of the nozzles widens under water pressure, so that already due to the passage of the water, when the valve is fully opened, the hard contaminations and calcium deposits crack and split off due to the expansion of the inner nozzle wall.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
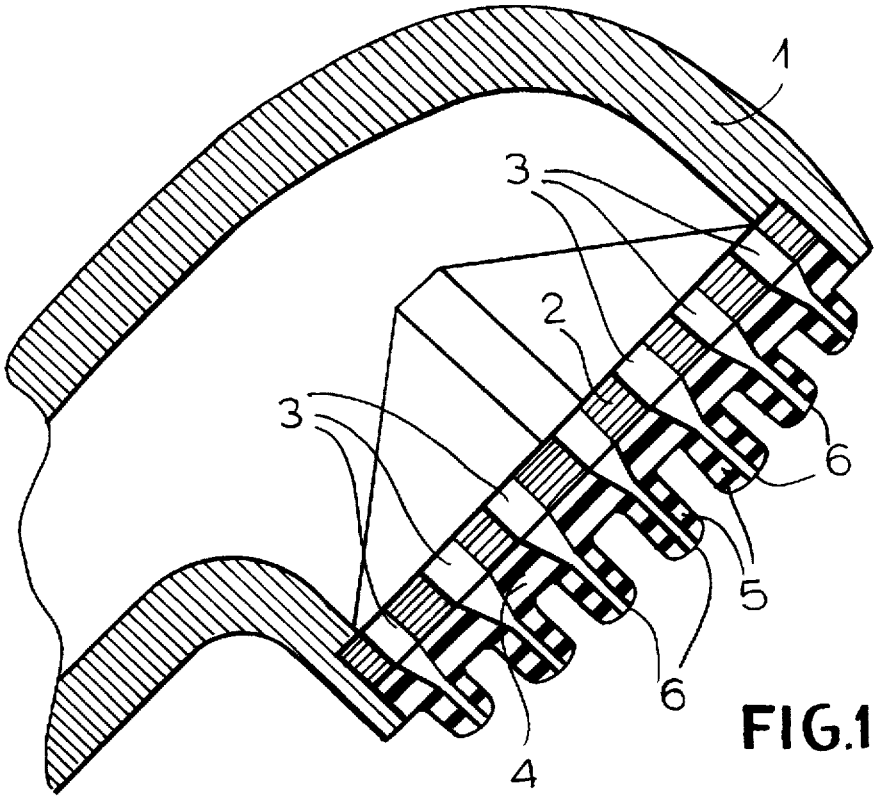
FIG. 1 is a cross sectional view through a shower head according to the invention.
Figure 3:
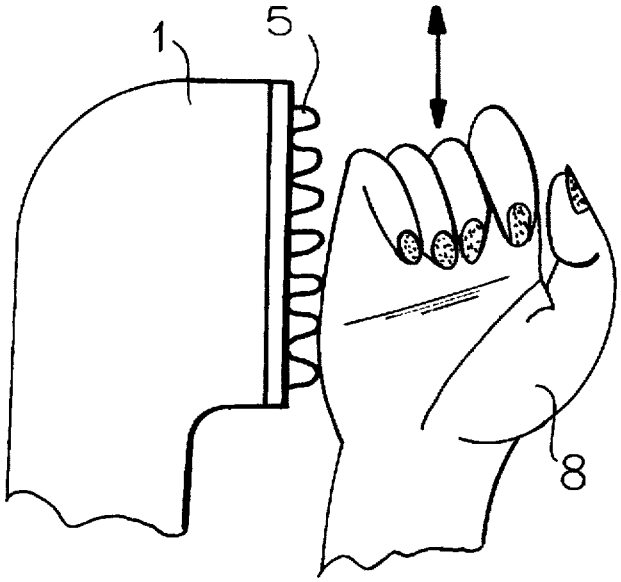
FIG. 3 is an elevational view of the shower head, showing the deflection of the nozzle for decalcification.
Figure 2B:
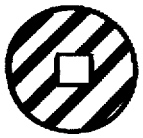
FIG. 2A–2C are cross sectional views taken along the line II—II of FIG. 2 showing various configurations of the interior passage of the nozzle.
Figure 2C:
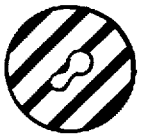
Figure 2A:
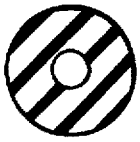
Figure 2:
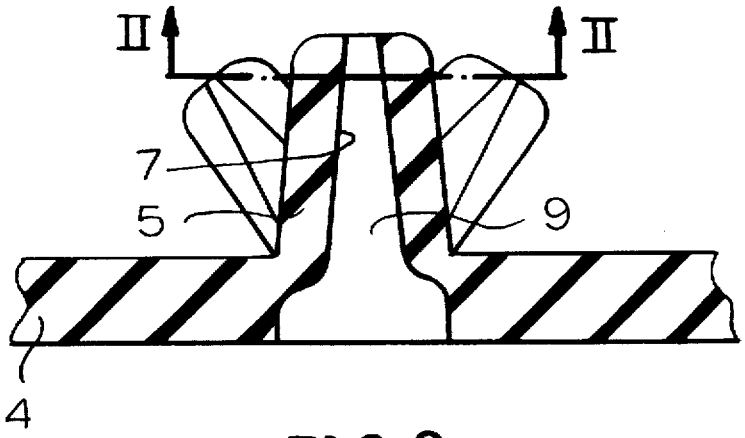
FIG. 2 is a detail view of a portion of the elastic plate showing one of the nozzles thereof.

FIG. 1 shows a shower head according to the invention in longitudinal section while FIG. 2 is an enlarged section of the plate with a nozzle in straight position and also shower various bent position, while FIG. 3 shows the cleansing back-and-forth bending of the nozzle by hand.

As can be seen in FIG. 1 a spray plate 2 with water passage openings 3 and a further plate 4 with nozzles 5 are inserted in a housing 1. The water passage openings 3 are large, in order to avoid their clogging by dirt and calcium deposits. The inner diameters of the nozzles 5 narrow down towards their exit openings 6, which are small in comparison to the water passage openings 3 and produce fine water jets which are pleasant to the skin.

If on the inner walls 7 of nozzles 5 deposits have formed, it is sufficient to rub, for instance with the edge of the palm 8, as shown in FIG. 3, against the nozzles 5 and to apply pressure. This way the nozzles 5 are bent as indicated in FIG. 2 and the hard contaminations and calcifications crack and split off the inner walls 7 of the nozzles 5 and are rinsed out by the passing water. The cross section of the nozzle channel 9 can be as shown in FIG. 2 either circular II*a* or also square II*b*, and is deformed to II*c* during the bending of the nozzle 5. The bending of the nozzles 5 can also be achieved by pressing against any surface. The shown shower head is also suitable for body massage, whereby the massaging effect is created on the one hand by the elastic nozzles 5 and on the other hand by the water jets. Preferably thereby the surrounding surface of the exit passages 6 of nozzles 5 is curved, as shown in FIG. 1. At the same time the pressure against the skin causes a cleansing of the nozzles 5 as previously described. The material of the nozzles 5 should have corresponding elasticity and the wall thickness of nozzles 5 should not be too big, so that no sizable effort has to be made for the cleansing of nozzles 5. As shown, advantageously the wall thickness of nozzles 5 should not be bigger than their inner diameter. With a corresponding material selection and dimensioning of the nozzles it is also possible to achieve a widening of the exit openings 6 due to water pressure, so that when the water flows through the expanded inner walls 7 of nozzles 5 it already causes a cracking and splitting of the hard deposits, thereby achieving a cleaning effect.

I claim:

1. A shower head comprising:

a shower head housing connectable to a source of water;

a spray plate in said housing having a multiplicity of water passage openings for discharging respective streams of water from said housing; and a further plate in said housing lying against said spray plate, formed of an elastic material, defining an outer face of said shower head, and provided with a multiplicity of laterally deflectable unconfined nozzles projecting freely outwardly from said face, and free to deflect laterally at junctions of said nozzles with said plates, each of said nozzles being coaxially aligned with a respective one of said openings for producing a respective jet of water, said nozzles having exit orifices which are smaller than said water passage openings, lateral deflection of said nozzles by a user breaking up calcification in said nozzles.

2. The shower head defined in claim 1 wherein each of said nozzles has an inner diameter greater than a wall thickness of the respective nozzle.

3. The shower head defined in claim 1 wherein each of said nozzles is constructed and arranged so that an inner diameter thereof expands under water pressure.

* * * * *